US006129835A

United States Patent [19]

Lesieur et al.

[11] Patent Number: 6,129,835

[45] Date of Patent: Oct. 10, 2000

[54] SYSTEM AND METHOD FOR DESULFURIZING GASOLINE OR DIESEL FUEL TO PRODUCE A LOW SULFUR-CONTENT FUEL FOR USE IN AN INTERNAL COMBUSTION ENGINE

[75] Inventors: Roger R. Lesieur, Enfield; Leonard J. Bonville, Jr., Marlbrough, both of Conn.

[73] Assignee: International Fuel Cells, LLC, South Windsor, Conn.

[21] Appl. No.: 09/221,429

[22] Filed: Dec. 28, 1998

[51] Int. Cl.[7] ..... C10G 45/00

[52] U.S. Cl. ..... 208/208 R; 208/244; 208/299; 123/1 A

[58] Field of Search ..... 208/208 R, 244, 208/299; 123/1 A

[56] References Cited

U.S. PATENT DOCUMENTS

| | | | |
|---|---|---|---|
| 809,087 | 1/1906 | Blackmore | 208/244 |
| 1,758,796 | 5/1930 | Joseph | 423/230 |
| 2,185,380 | 1/1940 | McGee et al. | 208/244 |
| 2,615,831 | 10/1952 | Bishop et al. | 426/261 |
| 2,618,586 | 11/1952 | Hendel | 208/243 |
| 3,485,746 | 12/1969 | Setzer et al. | 208/244 |
| 3,828,736 | 8/1974 | Koch | 123/3 |
| 4,336,130 | 6/1982 | Miller et al. | 208/243 |
| 4,347,811 | 9/1982 | Lee | 123/1 A |
| 4,419,968 | 12/1983 | Lee | 123/3 |
| 4,610,780 | 9/1986 | Grove et al. | 208/244 |
| 4,715,325 | 12/1987 | Walker | 123/1 A |
| 4,830,735 | 5/1989 | Debras et al. | 208/244 |
| 5,324,420 | 6/1994 | De Munck et al. | 208/124 |
| 5,470,456 | 11/1995 | Debras et al. | 208/244 |
| 5,674,379 | 10/1997 | Debras et al. | 208/244 |
| 5,843,300 | 12/1998 | Zinnen et al. | 208/250 |
| 5,853,570 | 12/1998 | Hatanka et al. | 208/216 PP |
| 5,882,614 | 3/1999 | Taylor, Jr. et al. | 423/230 |

*Primary Examiner*—Walter D. Griffin
*Assistant Examiner*—Nadine Preisch
*Attorney, Agent, or Firm*—William W. Jones

[57] ABSTRACT

A fuel processing system is operable to remove substantially all of the sulfur present in gasoline or diesel fuel used for operating an internal combustion engine. The fuel supply is passed through a nickel reactant desulfurizer bed wherein essentially all of the sulfur in organic sulfur compounds in the fuel combine with the nickel reactant in the desulfurizer bed, and are converted to nickel sulfide. The desulfurizing system can operate at ambient or elevated pressures. The fuel can be treated either in a liquid phase or in a vapor phase. The sulfur scrubbing operation can be performed either in a vehicle while the latter is being operated, or at the fueling station (gas station) prior to sale to the end user. The amount of sulfur in the fuel can be lowered to less than about 0.05 ppm. This extends the life of the catalytic converters in vehicles, reduces corrosion of parts of the internal combustion engine, and provides an environmentally compatible system.

8 Claims, 2 Drawing Sheets

Figure 1:
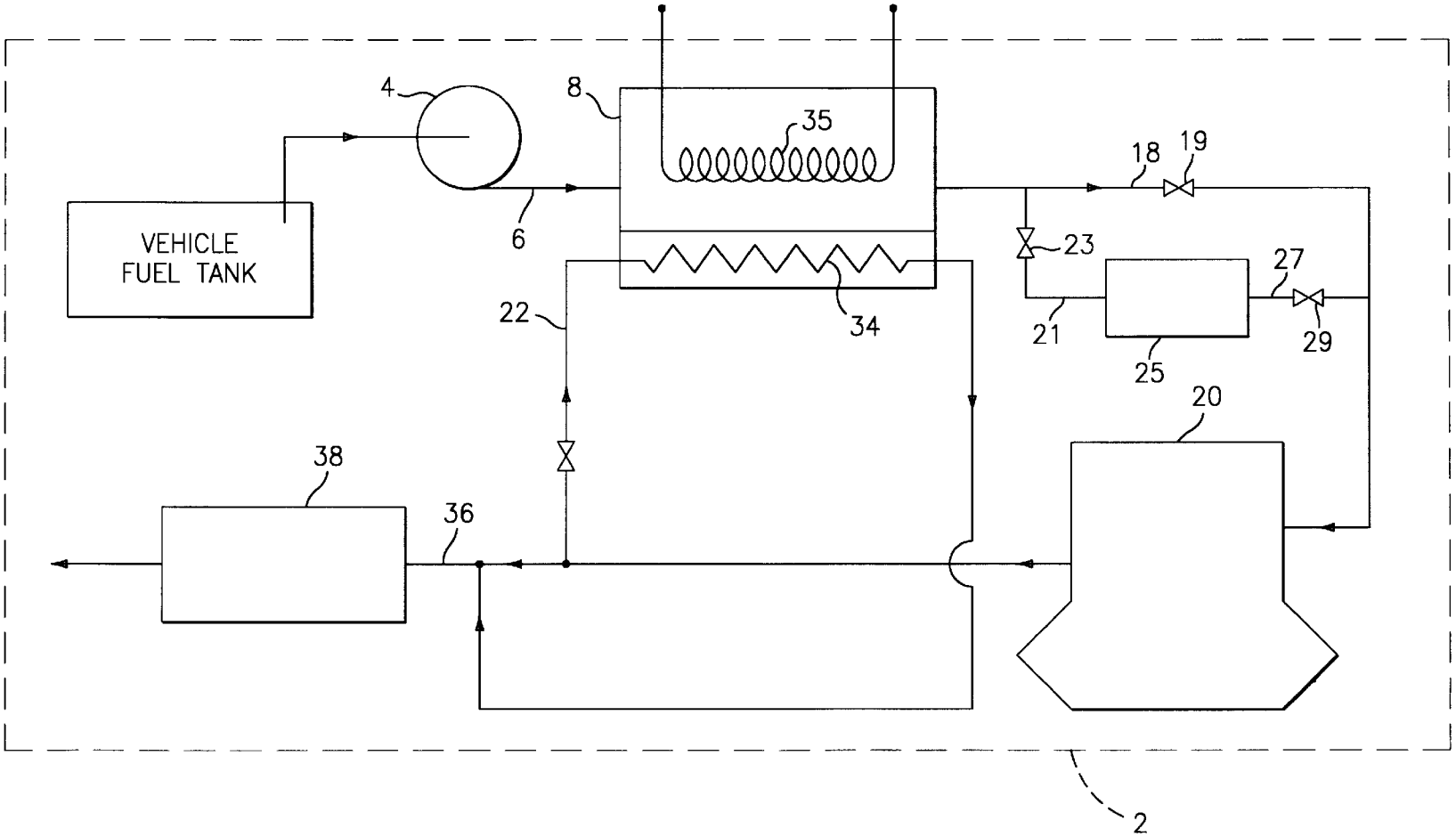

SYSTEM AND METHOD FOR DESULFURIZING GASOLINE OR DIESEL FUEL TO PRODUCE A LOW SULFUR-CONTENT FUEL FOR USE IN AN INTERNAL COMBUSTION ENGINE

TECHNICAL FIELD

The present invention relates to an improved system for desulfurizing a gasoline or diesel fuel supply so as to render the fuel less corrosive and cleaner for use in an internal combustion engine. More particularly, the desulfurizing system of this invention is operable to reduce sulfur contaminants found in the fuel to levels which will reduce internal combustion engine corrosion, and will also reduce particulate deposition in diesel engines. Additionally, the system of this invention will extend the useful life of catalytic exhaust converter components in internal combustion engine vehicles.

BACKGROUND OF THE INVENTION

The operation of an internal combustion engine is affected by a number of factors not the least of which is the sulfur content in the fuel supply. Typical internal combustion engine fuels such as gasoline and diesel fuel contain relatively high levels of sulfur, normally in the form of organic sulfur compounds. The specification for diesel fuel is about 500 parts per million (ppm) although the average is significantly below this level. The US average for regular gasoline is about 350 ppm. Current efforts to reduce internal combustion engine fuel sulfur levels, such as the present California Phase II specification, call for sulfur content limits in gasoline of less than about 40 ppm. The benefit of lowering sulfur content in engine fuel is a reduction in sulfur pollution levels from automobiles as well as reducing the effects of engine component corrosion and the negative effects of sulfur on the engine catalytic converters.

Sulfur oxide emissions from the automobile's internal combustion engine contributes to acid rain. In diesel engines, high sulfur levels result in increased particulate levels in the exhaust. High sulfur levels also contribute to more rapid corrosion of engine materials, and to a lowering of catalytic converter effectiveness, which means more nitrogen oxide formation, and a lower activity level for the conversion of carbon monoxide and unburned hydrocarbons.

While the California phase II specification deals with sulfur levels in the original fuel source, other sulfur clean up methods proposed to date for diesel and gasoline internal combustion engines are focused on cleaning up the exhaust after the combustion process. While these post-combustion clean up approaches can be made to work, it is far more desirable to reduce or remove the sulfur before the combustion cycle. Sulfur clean up processes for liquid fuels such as those described in an article published in connection with the 21st Power Sources Conference proceedings of May 16–18, 1967, pages 21–26, entitled "Sulfur Removal for Hydrocarbon Air Systems" require complex equipment which is not easily incorporated in a vehicle.

It would be highly desirable therefore, from an environmental, cost and equipment durability stand point to be able to power a diesel or gasoline fueled internal combustion engine by means of a desulfurized fuel, i.e., a fuel containing less than about 0.05 ppm sulfur.

DISCLOSURE OF THE INVENTION

This invention relates to a fuel processing system which is operable to remove substantially all of the sulfur present in a gasoline or diesel fuel stock used to power an internal combustion engine. The fuel can contain relatively high levels of organic sulfur compounds such as thiophenes, mercaptans, sulfides, disulfides, and the like. The fuel is passed through a nickel desulfurizer bed wherein essentially all of the sulfur in the organic sulfur compounds react with the nickel reactant and are converted to nickel sulfide, leaving a desulfurized fuel supply which continues through the internal combustion engine. Since this desulfurizer requires no water or recycle addition, it can be made compact and simple when compared to alternate approaches, and it is not limited by thermodynamic considerations in the presence of water, as are other sulfur absorbents such as zinc oxide or iron oxide.

The desulfurization can take place at a fueling station as the fuel is being delivered to the vehicle; or it can take place on board the vehicle. When desulfurization is done at the fueling station, a small sulfur scrubber could also be included in the vehicle. Desulfurization can be performed on the fuel either in a liquid state or a vaporous state. When desulfurization is performed on board the vehicle, the fuel will pass through the nickel desulfurizer reactant bed and thence into the internal combustion engine.

It is therefore an object of this invention to provide a fuel processing system and method which is suitable for use in desulfurizing a fuel such as gasoline or diesel fuel.

It is an additional object of this invention to provide a fuel processing system of the character described wherein raw fuel is passed through a desulfurizing bed wherein sulfur is removed from the fuel.

It is a further object of this invention to provide a fuel processing system of the character described wherein the desulfurizing bed is a nickel reactant bed.

It is another object of this invention to provide a fuel processing system of the character described wherein the sulfur content of the fuel will be reduced to less than about 0.05 parts per million.

Figure 2:
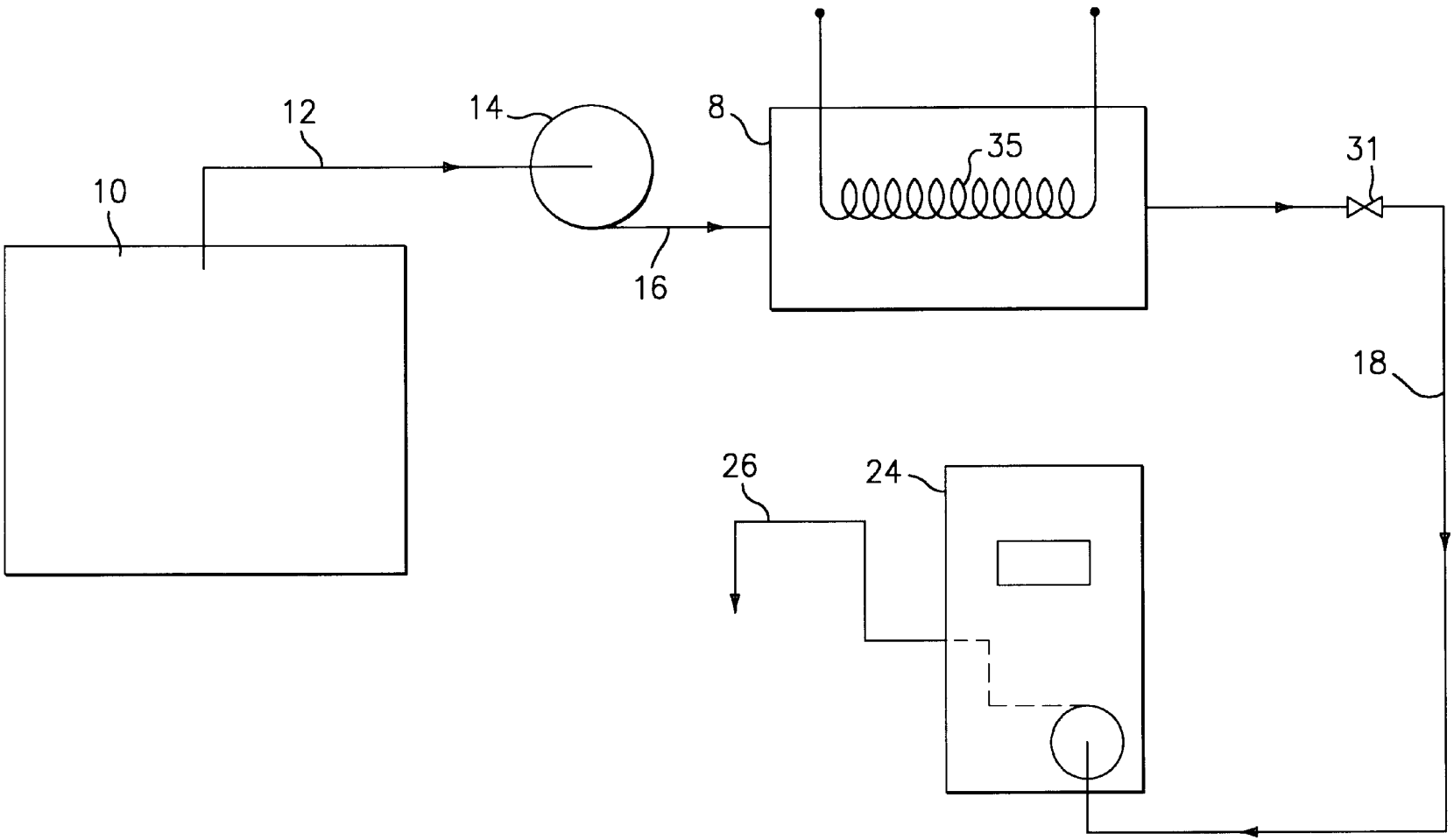

These and other objects of the invention will become more readily apparent from the following detailed description thereof when taken in conjunction with the accompanying drawings in which:

FIG. 1 is a schematic view of an embodiment of a fuel processing system which is suitable for use in a vehicle; and FIG. 2 is a schematic view of a second embodiment of a fuel processing system which is suitable for use in a vehicle fueling station.

SPECIFIC MODES FOR CARRYING OUT THE INVENTION

Referring now to the drawings, FIG. 1 is a schematic view of a fuel processing system, denoted generally by the numeral 2, which is suitable for use in a vehicle such as an automobile, bus, truck, or the like. The fuel being processed can be gasoline or diesel fuel. A fuel pump 4 pumps the fuel into the system 2 via line 6 which leads to a nickel desulfurizer bed 8. Organic sulfur compounds in the gasoline are broken down by the nickel reactant per the following typical reactions:

$$Ni+CH_3SH \rightarrow NiS+CH_4; \text{ and}$$

$$Ni+CH_3SCH_3 \rightarrow NiS+C_2H_6.$$

The desulfurizer 8 operates at a pressure of between ambient and about one hundred fifty psi, and a temperature of between about 200° F. and 525° F. so that liquid fuel entering the desulfurizer 8 at a temperature of about 75° F. (ambient) will be preheated and either vaporized, or remain a liquid, in the desulfurizer 8, depending on the operating pressures and temperatures. The preferred operating temperature range is between about 325° F. to about 400° F., as this provides the optimum range of sulfur conversion while maintaining low carbon formation. The liquid or vaporized fuel then enters a heat exchange line 18 which adjusts the temperature of the fuel to its desired level before the fuel enters the vehicle's internal combustion engine 20. The line 18 may include a flow control valve 19, and may be associated with a branch line 21 which includes a flow control valve 23. The line 21 leads to an auxiliary fuel storage tank 25 in which desulfurized fuel can be stored for use in starting up and running the engine 20 until such time as the desulfurizer 8 reaches operating temperatures. An outlet line 27 having a flow control valve 29 extends from the storage tank 25 back to the line 18. The valves 19, 23 and 29 can be selectively controlled by the vehicle's onboard microprocessor.

The desulfurizer station 8 can be heated to its operating temperature with recirculated engine exhaust which is fed to a heat exchanger 34 through line 22, or the desulfurizer 8 can be heated by means of an electric heater 35. If desired, both of the aforesaid heating protocols could be used in combination or in series. When recirculated engine exhaust is utilized to heat the desulfurizer 8, the exhaust is flushed from the vehicle via exhaust pipe 36 in which the conventional catalytic converter 38 may be positioned.

Referring now to FIG. 2, an alternative embodiment of the system 2, which is designed for use in a fueling station, is depicted. The fueling station includes a fuel storage tank 10 which contains the raw fuel. Raw fuel is pumped from the storage tank 10 through a line 12 by means of a pump 14 and into a line 16 to the desulfurizer 8. The desulfurizer 8 is heated to operating temperatures by means of an electric heater 35 which may include a regenerative heat exchanger (not shown). The desulfurized fuel is then channeled through a line 18 to a fuel filling pump 24 at the filling station. The fuel dispensing hose is denoted by the numeral 26. In cases where it is desirable to maintain the fuel in a liquid form in the desulfurization station 8, a back pressure valve 31 in line 18 can be used in conjunction with the pump 14 to produce operating pressures in the range of about 50 psi to about 150 psi in the desulfurization station 8, as shown in FIG. 2. The same pressure control system could be incorporated into the embodiment shown in FIG. 1.

It will be readily appreciated that by using a nickel desulfurizer, the amount of sulfur in the fuel stream can be lowered to less than about 0.05 parts per million, a level which will not significantly damage the components of an internal combustion engine, and will not significantly damage the catalytic converter in the exhaust system of the engine.

Since many changes and variations of the disclosed embodiment of the invention may be made without departing from the inventive concept, it is not intended to limit the invention otherwise than as required by the appended claims.

What is claimed is:

1. A system for desulfurizing a gasoline or diesel fuel so as to produce a lower sulfur content gasoline or diesel fuel for use in an internal combustion engine, said system comprising:

a) a nickel desulfurization station containing a nickel reactant which is operative to convert sulfur contained in organic sulfur compounds contained in the fuel to nickel sulfide in the desulfurization station thereby removing sulfur from the fuel;

b) means for introducing the fuel into said nickel desulfurization station; and c) means for maintaining said nickel desulfurization station at an operating temperature in the range of about 200° F. to about 525° F. during operation of said system.

2. The system of claim 1 wherein said desulfurization station operates a temperature in the range of about 325° F. to about 400° F.

3. The system of claim 1 further comprising means for maintaining said desulfurization station at a pressure in a range of about 50 psi to about 150 psi which will maintain the fuel in a liquid state during operation of the system.

4. The system of claim 1 wherein said desulfurization station is operable to lower the concentration of sulfur in the fuel to less than about 0.05 ppm.

5. A method for desulfurizing a gasoline or diesel fuel so as to produce a lower sulfur content gasoline or diesel fuel for use in an internal combustion engine, said method comprising:

a) a step of providing a nickel desulfurization station containing a nickel reactant which is operative to convert sulfur contained in organic sulfur compounds contained in the fuel to nickel sulfide in the desulfurization station thereby removing sulfur from the fuel;

b) a step of introducing the fuel into said desulfurization station; and c) a step of maintaining said desulfurization station at an operating temperature in the range of about 200° F. to about 525° F. during operation of said method.

6. The method of claim 5 comprising the step of maintaining said desulfurization station at an operating temperature in the range of about 325° F. to about 400° F.

7. The method of claim 5 comprising the step of operating said desulfurization station at a pressure in the range of about 50 psi to about 150 psi so as to maintain the fuel in a liquid state in said nickel desulfurizer station.

8. The method of claim 5 wherein said desulfurization station is operable to lower the concentration of sulfur in the fuel to less than about 0.05 ppm.

* * * * *